US007779496B2

(12) United States Patent
Crousore et al.

(10) Patent No.: US 7,779,496 B2
(45) Date of Patent: Aug. 24, 2010

(54) AIR MATTRESS FOR BED WITH STEP DECK

(75) Inventors: Robert Crousore, Carlsbad, CA (US); John R. Laverack, Southbury, CT (US); Douglas B. Winner, Newtown, CT (US)

(73) Assignee: Joerns LLC, Van Nuys, CA (US)

( * ) Notice: Subject to any disclaimer, the term of this patent is extended or adjusted under 35 U.S.C. 154(b) by 554 days.

(21) Appl. No.: 11/810,215

(22) Filed: Jun. 5, 2007

(65) Prior Publication Data

US 2007/0234480 A1 Oct. 11, 2007

Related U.S. Application Data

(63) Continuation-in-part of application No. 11/616,266, filed on Dec. 26, 2006, now Pat. No. 7,380,302, which is a continuation of application No. 11/002,604, filed on Dec. 2, 2004, now Pat. No. 7,155,766.

(51) Int. Cl.
*A47C 27/10* (2006.01)
*A61G 7/057* (2006.01)

(52) U.S. Cl. ..... 5/710; 5/713; 5/715; 5/411; 5/739; 5/738

(58) Field of Classification Search ..... 5/706, 5/710, 713–715, 738, 739, 663, 411
See application file for complete search history.

(56) References Cited

U.S. PATENT DOCUMENTS

| | | | |
|---|---|---|---|
| 5,126,772 | A | 6/1992 | Albrecht |
| 5,136,741 | A | 8/1992 | Balonick |
| 5,367,728 | A | 11/1994 | Chang |
| 5,682,631 | A | 11/1997 | Weismiller et al. |
| 5,692,256 | A | 12/1997 | Kramer et al. |
| 5,715,548 | A | 2/1998 | Weismiller et al. |
| 5,724,685 | A | 3/1998 | Weismiller et al. |
| 5,737,788 | A | 4/1998 | Castellino et al. |
| 5,745,937 | A | 5/1998 | Weismiller et al. |
| 5,802,646 | A | 9/1998 | Stolpmann et al. |
| 5,815,865 | A | 10/1998 | Washburn et al. |
| 5,940,910 | A | 8/1999 | Weismiller et al. |
| 6,079,070 | A | 6/2000 | Flick |

(Continued)

FOREIGN PATENT DOCUMENTS

JP 03 023813 1/2003

OTHER PUBLICATIONS

EPC, Examination Report, dated Dec. 18, 2009, from related European Patent application.

*Primary Examiner*—Michael Trettel
(74) *Attorney, Agent, or Firm*—MacMillan, Sobanski & Todd, LLC

(57) ABSTRACT

A bed comprises a bed frame and a bed deck supported by the bed frame. The bed deck comprises a step deck, including a lower deck, an upper deck, a side wall connecting the lower deck to the upper deck, and a recess defined by the lower deck and the side wall. The side wall at least partially surrounds the recess. A mattress comprises a safety mattress extending across the lower bed deck and having air cells including air cells resting on the upper bed deck.

17 Claims, 16 Drawing Sheets

U.S. PATENT DOCUMENTS

| | | | |
|---|---|---|---|
| 6,163,903 | A | 12/2000 | Weismiller et al. |
| 6,178,578 | B1 | 1/2001 | Soltani et al. |
| 6,212,718 | B1 | 4/2001 | Stolpmannet et al. |
| 6,223,369 | B1 | 5/2001 | Maieret et al. |
| 6,243,894 | B1 | 6/2001 | Kosumsuppamala et al. |
| 6,256,822 | B1 | 7/2001 | Weston et al. |
| 6,286,167 | B1 | 9/2001 | Stolpmann |
| 6,336,235 | B1 | 1/2002 | Ruehl |
| 6,499,167 | B1 | 12/2002 | Ellis et al. |
| 6,701,556 | B2 | 3/2004 | Romano et al. |
| 6,782,209 | B2 | 8/2004 | Copeland et al. |
| 6,848,138 | B1 | 2/2005 | Maier et al. |
| 7,086,107 | B2 | 8/2006 | Ellis et al. |
| 7,216,384 | B2 | 5/2007 | Allen et al. |
| 7,216,389 | B2 | 5/2007 | Ellis et al. |
| 2001/0027576 | A1 | 10/2001 | Kosumsuppamala et al. |

AIR MATTRESS FOR BED WITH STEP DECK

CROSS REFERENCE TO RELATED APPLICATIONS

This application is a continuation-in-part of application Ser. No. 11/616,266 filed Dec. 26, 2006, granted as U.S. Pat. No. 7,380,302, which was a continuation of application Ser. No. 11/002,604 filed on Dec. 2, 2004, granted as U.S. Pat. No. 7,155,766 on Jan. 2, 2007, assigned to the assignee of this application, the disclosure of which is hereby incorporated by reference.

BACKGROUND OF INVENTION

This invention relates in general to beds and more particularly to beds having a step deck and a mattress positioned on the step deck to provide a support surface for a person using the bed.

Beds with step decks are well known. Such a bed is manufactured and sold under the name VERSACARE by Hill-Rom Company, Inc. of Batesville, Ind., USA. The bed frame can reduce in length by about 10-11 inches (25.4-27.94 cm) via an actuator at the foot end of the bed to transport the bed.

An air mattress is needed for use with beds having a step deck.

SUMMARY OF INVENTION

The present invention is directed towards a bed comprising a bed frame and a bed deck supported by the bed frame. The bed deck comprises a step deck, including a lower deck, an upper deck, a side wall connecting the lower deck to the upper deck, and a recess defined by the lower deck and the side wall. The side wall at least partially surrounds the recess. A mattress comprises a safety mattress extending across the lower bed deck and having air cells including upper outermost side air cells resting on the upper bed deck.

The invention will become apparent to those skilled in the art from the following detailed description of the preferred embodiment, when read in light of the accompanying drawings.

DETAILED DESCRIPTION

Figure 1:
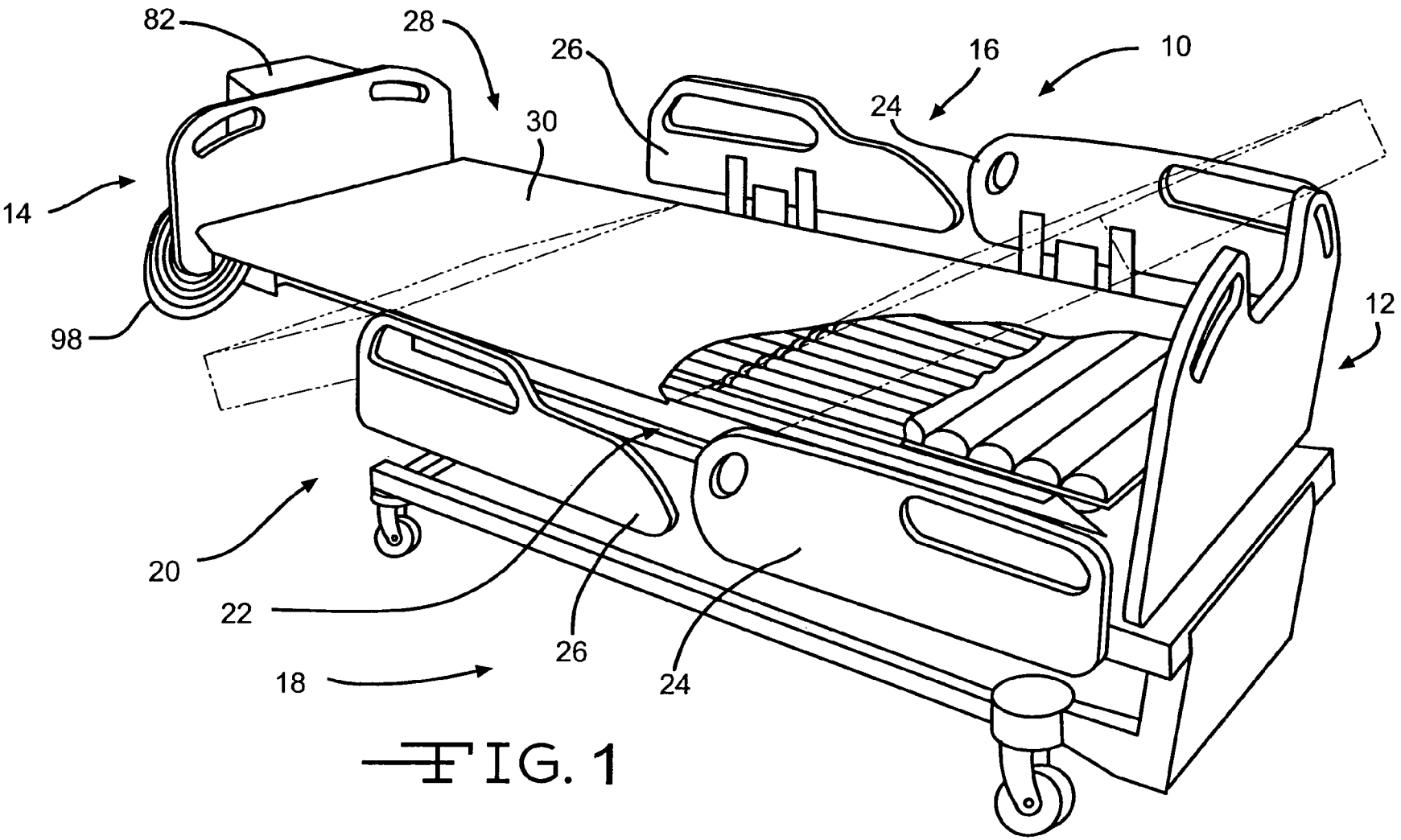
FIG. 1 is a perspective view of an exemplary bed and mattress, shown in solid line in a conventional bed position and in phantom line in a seated position.

Referring now to the drawings, there is illustrated in FIG. 1 an exemplary bed 10 having a head end 12, a foot end 14, and right and left sides 16, 18. The bed 10 includes a bed frame 20 and a bed deck 22 supported by the bed frame 20. The bed 10 may include head and foot end side rails 24, 26 supported in relation to the bed deck 22 and a mattress 28 supported by the bed deck 22. The mattress 28 provides a support surface 30 for supporting a person using the bed 10. The bed 10 may assume a variety of positions such as a conventional bed position, as shown in solid line, and a seated position, as shown in phantom line. This may be achieved by articulating the bed deck 22.

Figure 2:
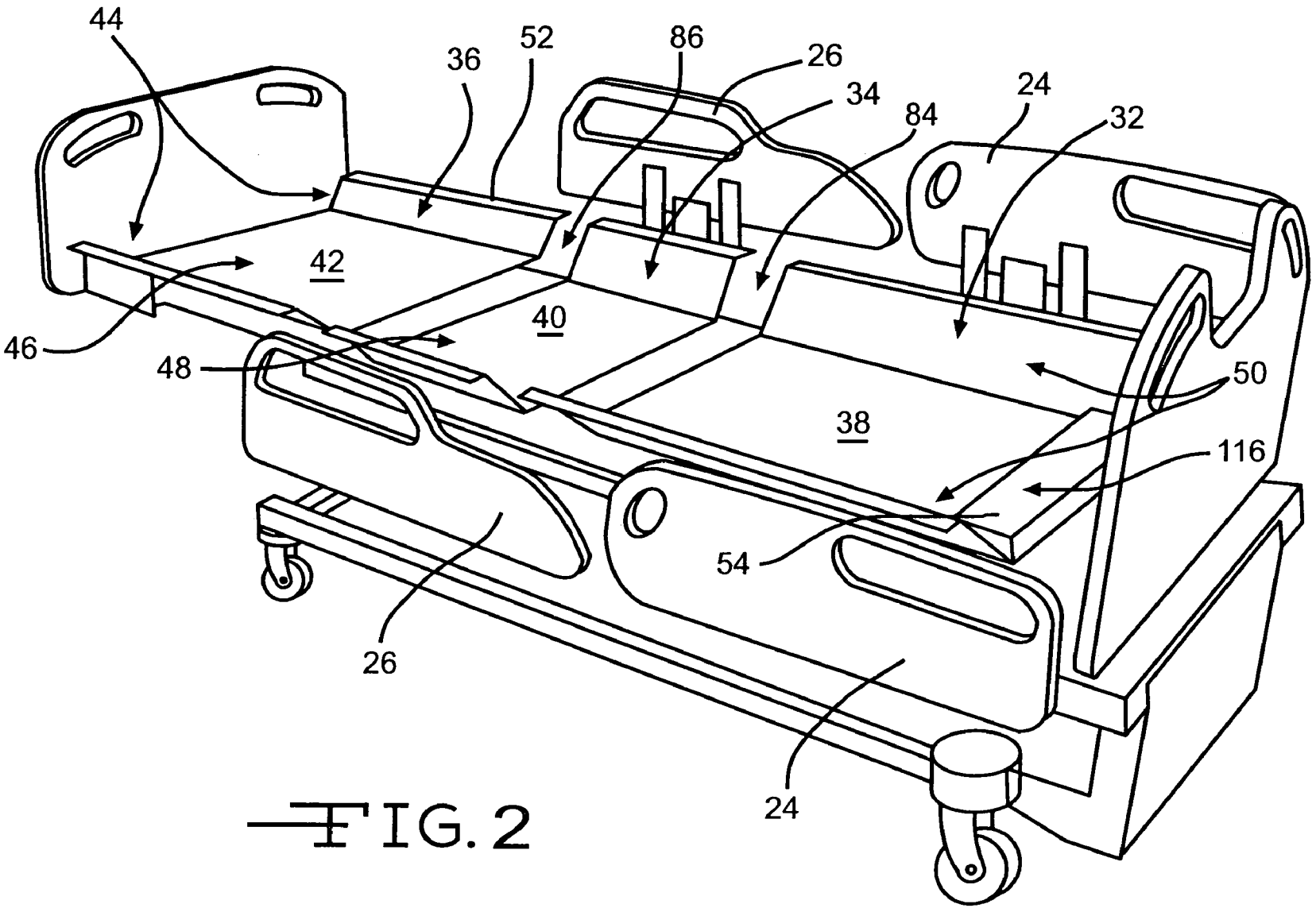
FIG. 2 is a perspective view of the bed shown in FIG. 1 with the mattress removed.

The bed deck 22 may include a head section 32, a seat section 34, and a foot section 36, which may respectively include head, seat and foot pans 38, 40, 42, as shown in FIG. 2. When articulating the bed deck 22, the head and foot sections 32, 36 may move relative to one another or relative to the seat section 34. The head section 32 and the foot section 36 may move relative to each other to change the angle of inclination of the back and the legs of the person using the bed 10 with respect to the seat section 34. An example of an articulation of the bed deck 22 and mechanisms that facilitate movement of the bed deck is described in U.S. Pat. No. 5,715,536, to Weismiller et al., issued Feb. 10, 1998, the disclosure of which is hereby incorporated by reference.

Additionally, the bed deck 22 may be in the form of a step deck, including an upper deck 44 and a central, longitudinally extending recess 46, which may be defined by a lower deck 48 of the bed deck 22 and a side wall 50 at least partially surrounding the recess 46 and connecting the lower deck 48 to the upper deck 44. The upper deck 44 may include longitudinally extending upper deck side portions 52 and a head end upper deck portion 54 appended to a head end of the head section 32. An example of a bed deck 22 is described in U.S. Pat. No. 5,692,256, to Weismiller et al., granted Dec. 2, 1997, the disclosure of which is hereby incorporated by reference.

The head end side rails 24 may be mounted to the head section 32 of the bed deck 22 and the foot end side rails 26 may be mounted to the bed frame 20 adjacent to the seat section 40 of the bed deck 22. The bed deck 22 may cooperate with side rails 24, 26 to maximize the height relative to the support surface 30 at which side rails 24, 26 may be mounted.

The tops of side rails 24, 26 are higher when in the raised position for improved coverage and protection of the person on the support surface 30 and the bottoms may be higher when in the tucked position for improved access to the bed frame 20.

The head end side rails 24 may be mounted to move with the head section 32 as the head section 32 pivots relative to the bed frame 20 between a lowered position and a raised position. The foot end side rails 26 may be mounted to the bed frame 20 and may be fixed relative to the bed frame 20 and seat section 34 so as to remain in a fixed position when the head and foot sections 32, 36 of the bed deck 22 are articulated.

Figure 3:
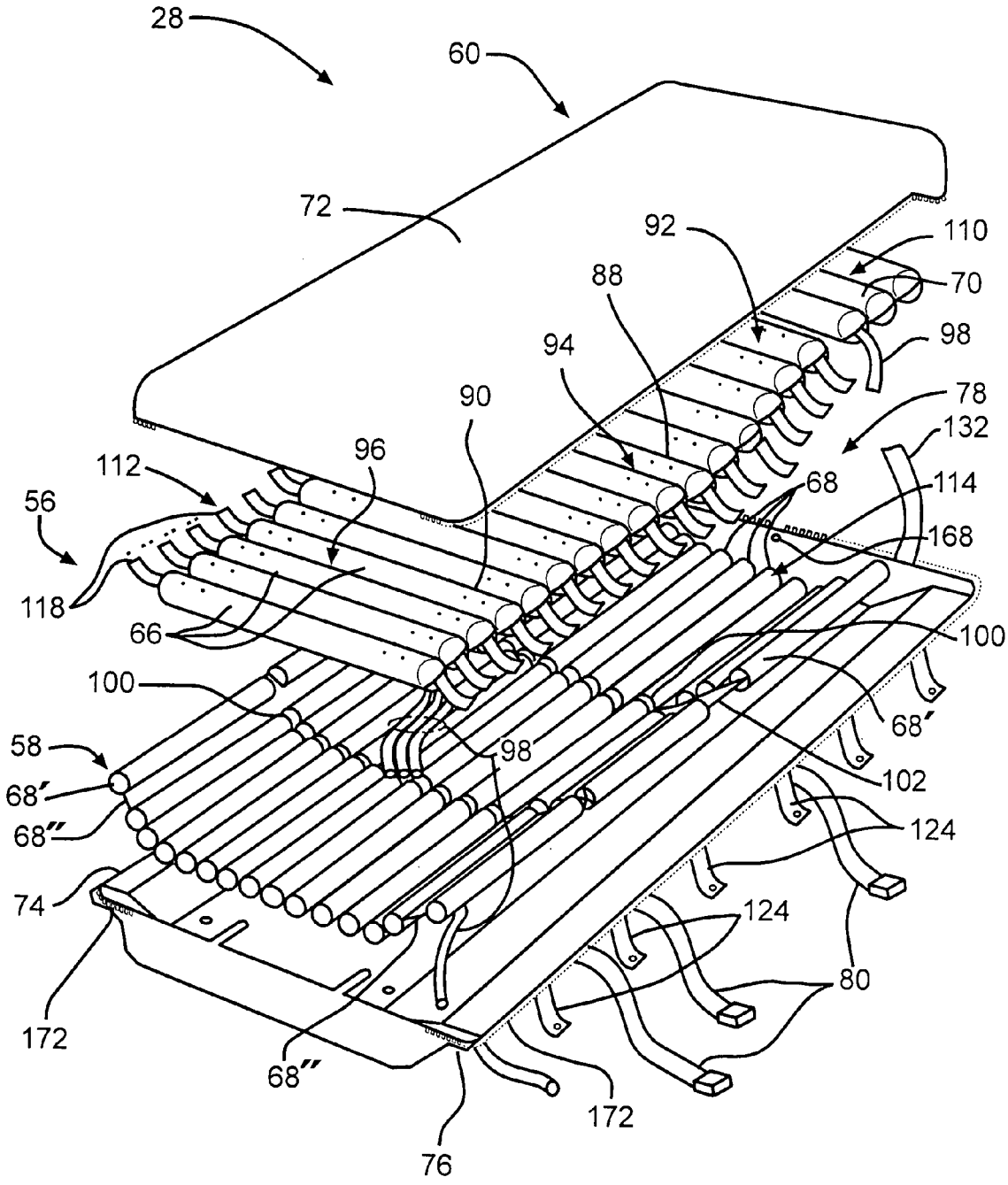
FIG. 3 is an exploded perspective view of the exemplary mattress.

The mattress 28 may include one or more mattress portions 56, 58 and a cover 60 positioned around mattress portions 56, 58, as shown in FIG. 3. The mattress portions 56, 58 may be structured to provide resilient support for the person positioned on the support surface 30. The cover 60 may protect the mattress portions 56, 58 from becoming soiled during use and forms the support surface 30 of the mattress 28.

The mattress portions 56, 58 may include various components such as low air loss (LAL) cells, foam pads, fluidized cells, or any other configurations that provide support for the person positioned on the mattress portions 56, 58. The exemplary mattress portions 56, 58 include several inflatable bladders or air cells 66, 68, 70 that provide support to the person positioned on the support surface 30. The cells 66, 68, 70 may be formed, for example, from stamped layers of polyurethane coated nylon sealed via welding (e.g., ultrasonic or radio frequency (RF) welding), gluing, fusing, bonding, sewing or other suitable seal.

The mattress portions 56, 58 may be configured to have separate portions positioned over the head, seat and foot sections 32, 34, 36 of the bed 10. Thus, the mattress portions 56, 58 may each comprise either a single component positioned over all the sections 32, 34, 36 of the bed deck 22 or multiple components positioned over one or more sections 32, 34, 36 of the bed deck 22.

The cover 60 may include top and bottom sections 72, 74. The top section 72 may define the support surface 30 and may protect the mattress portions 56, 58. The bottom section 74 may define a lower surface 76 positioned over the upper deck 44 and the side wall 50. The top and bottom sections 72, 74 may cooperate to define an interior region 78 of the cover 60 in which the air cells 66, 68, 70 are positioned. Mattress straps 80 or other suitable supports may be positioned outside and below the cover 60. The straps 80 may be configured to support the mattress 28 in a position against the lower deck 48 so that the mattress 28 is positioned in the recess 46, as will become more apparent in the description that follows.

The mattress portions may include a LAL mattress 56 and an underlying safety mattress 58. The LAL mattress 56 may span laterally (i.e., left to right when viewing FIG. 4) or extend crosswise relative to the safety mattress 58 and between upper outermost side cells 68' of the safety mattress 58. The safety mattress 58 may extend longitudinally or crosswise to the LAL mattress 56 and beneath the LAL mattress 56. The safety mattress 58 may extend across the bed deck 22 and up the side wall 50 of the bed deck 22 so that the upper outermost side cells 68' of the safety mattress rest on the upper deck side portions 52.

The LAL mattress 56 may be a mattress formed of air cells 68 that provide the therapeutic benefit of pressure relief and skin moisture management for pressure ulcer therapy. A low air loss mattress that constantly leaks more than 100 liters a minute under the patient may provide a very conforming support surface which reduces local pressure on the bony prominences (e.g., sacrum, shoulder blades, and heels) and wick away built-in moisture that can cause softening and breakdown of skin tissue. Such a mattress may be connected to a controller blower or pump 82 (shown in FIG. 1) that may, for example, hang from the footboard at the foot end of the bed 10.

The cells 68 of the LAL mattress 56 may come in pairs. The exemplary LAL mattress 56 has three cells 68 in the head and seat section and two cells 68 in the foot section of the bed 10. The dimensions of the cells 68 may be specifically chosen so that the separation between the cells 68 is consistent, coincident or otherwise lines-up with where the hinge or pivot points 84, 86 (shown in FIG. 2) occur between the head and seat sections and the seat and foot sections of the articulating bed deck 22. This may provide a clean break between the cells 68 so that no cells 68 straddle the pivot points 84, 86.

For example, the exemplary LAL mattress 56 has eight 5 inch (12.7 cm)×10 inch (25.4 cm)×30 inch (76.2 cm) cells 68 that span the width of the mattress 28. The 10 inch (25.4 cm) dimension of the cells 68 of the LAL mattress 56 works well with the overall dimensions of the bed deck 22 to place intersections 88, 90 of the cells 68 conveniently at the pivot points 84, 86 of the bed deck 22 to reduce the risk that the mattress 28 will buckle when articulated.

The cells 68 of the LAL mattress 56 may be divided into different pressure zones, namely head, seat and foot zones 92, 94, 96. These different pressure zones 92, 94, 96 may be achieved by the provision of air bleed holes perforating the cells 68. The cells 68 may be connected via hose 98 to the controller pump 82 through various orifices to generate the different pressure zones 92, 94, 96, as will become more apparent in the description that follows.

The safety mattress 58 may be formed from contiguous cells 68, 68' that are at the same pressure, that is to say the cells 68, 68' of the entire safety mattress 58 may be one pressure. To achieve this, the cell 68, 68' of the safety mattress 58 may be in fluid communication with one another. The safety mattress 58 sits under the LAL mattress 56 and may be in the form of sealed (i.e., non-perforated) air cells that serve to support a person using the mattress 28 if the LAL mattress 56 should fail and deflate. Ideally, a sealed air cell would maintain its pressure indefinitely but due to conventional air cell construction, some leakage may occur so the air cell may bleed down over time. A safety mattress with air cells of conventional construction having a thickness of two inches (5.08 cm) may support a person using the mattress 28 for up to 12 hours if the LAL mattress 56 should fail and deflate. Cell pressure in the safety mattress 58 may be maintained by a check valve positioned between the cells 68, 68' and the pump 82.

Since the safety mattress 58 extends longitudinally or crosswise to the pivot points 84, 86 of the bed deck 22, the safety mattress 58 may be provided with short transverse welds 100 to form folding points that correspond to the pivot points 84, 86 of the bed deck 22 so that the safety mattress 58 may fold at the pivot points 84, 86 when the bed deck 22 is articulated. The safety mattress 58 may further be provided with welds that form a V-section 102 (one along each side of the safety mattress 58), wherein air is occluded from the cells 68, 68' in the V-section 102 of the cells 68, 68' to permit compression of the cells 68, 68' without buckling of the cells 68, 68' at the pivot point 84 between the head and seat sections 32, 34 of the bed deck 22 when the bed deck 22 is articulated.

It should be appreciated that there may be three cell configurations 110, 112, 114. For example, there may be a head cell configuration 110, a main body cell configuration 112, and a safety cell configuration 114. The head cell configuration 110 may include one or more head cells 70. The main body cell configuration 112 may include the LAL mattress 56. The safety cell configuration 114 may include the safety mattress 58. The head cells 70 need not be low air loss cells but may be low air loss cells if desirable.

The three cell configurations 110, 112, 114 may be enclosed in the cover 60, which may form a fabric surround. The top section 72 of the cover 60 may be in the form of a therapy cover, which may be in the form of a waterproof anti-microbial nylon therapy cover that reduces friction and shear. The cover 60 may have a fast-wicking acquisition layer to pull liquid quickly away from the skin. The bottom section 74 of the cover 60 may be in the form of a fabric tub. The exemplary fabric tub is sewn or otherwise tailored to fit or substantially conform to the shape of the bed deck 22. The aforementioned straps 80 may be attached to outside and below the fabric tub. The exemplary fabric tub has three straps 80 along each of its sides to strap the fabric tub in position on the bed deck 22, as will become more apparent in the description that follows. The exemplary fabric tub may have pleats that allow the fabric tub to conform to the bed deck 22.

Figure 4:
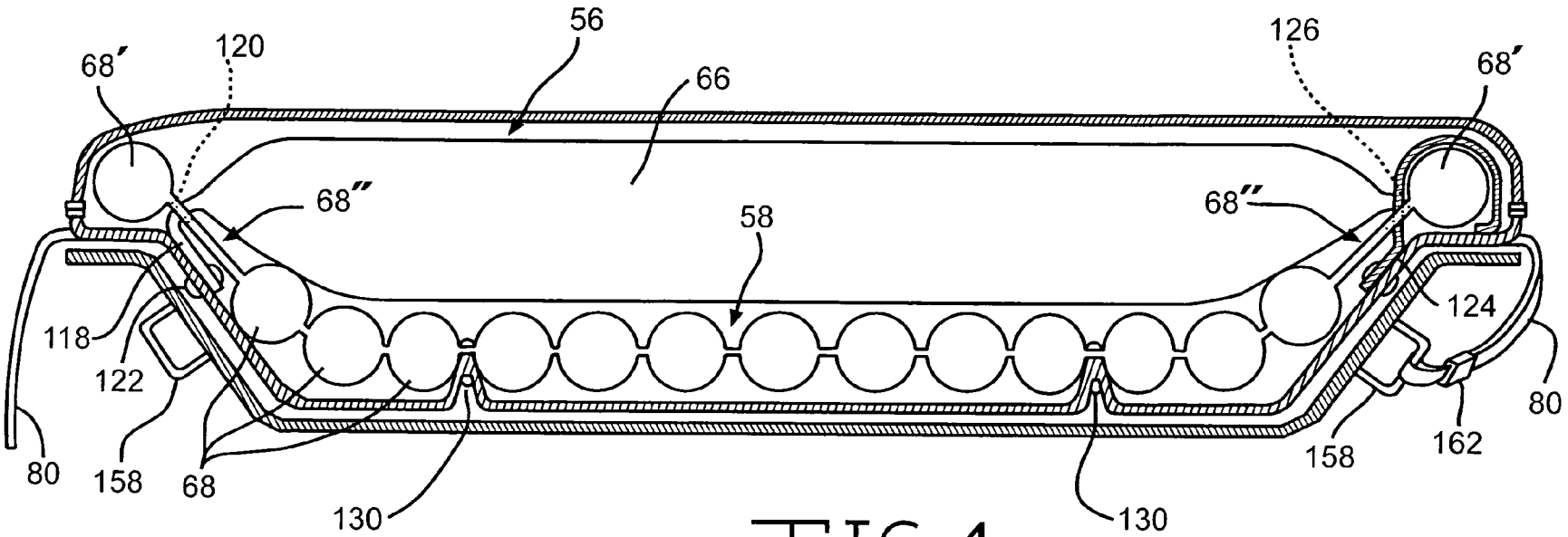
FIG. 4 is a partial sectional view of the bed deck, mattress portions, and an exemplary cover.

The fabric tub holds the cells 66, 68, 70 and may have integral straps and stamp fasteners or snaps, or other suitable structure, that permit the cell configurations 110, 112, 114 to be attached securely to the tub. For example, the cells 66 of the LAL mattress 56 may terminate in integral tabs or straps 120, which may thread through longitudinally spaced slits or openings 122 in the safety mattress 58 adjacent the outermost side cells 68' of the safety mattress 58 and may attach to the fabric tub via snaps 124, as shown in FIG. 4. The attachment of the cells 66 of the LAL mattress 56 to the fabric tub aids to keep the LAL mattress 56 together with other components of the mattress 28 and holds the cell configurations 112, 114 in place. Moreover, the attachment of cell configurations 112, 114 to the fabric tub begins to form, or aids in forming, a shape wherein the outermost side cells 68' of the safety mattress 58 are elevated above the rest of the cells 68 and the main body cell configuration 112 nests within the safety cell configuration 114.

The safety mattress 58 may in turn be strapped to the fabric tub by passing the straps 124 originating from opposing sides of the fabric tub through longitudinally spaced slits or openings 126 in the safety mattress adjacent the outermost side cells 68' of the safety mattress 58. In the exemplary mattress 28, there are two such straps 124 on each side of the fabric tub corresponding to each zone (e.g., head, seat and foot zones 92, 94, 96) of the safety mattress 58 (see FIG. 3). The straps 124 may be attached to the fabric tub via snaps 130. It should be appreciated that the safety mattress 58 may have dead cells 68" inward and adjacent to the upper outermost side cells 68' of the safety mattress 58, through which the longitudinally spaced slits or openings 126 may be provided. Alternatively, a web or other suitable structure may provide a space between the upper outermost side cells 68' of the safety mattress 58 and the cells adjacent the uppermost side cells 68', wherein the space is greater than the space between all the other adjacent cells 68 between the uppermost side cells 68'.

Figure 5:
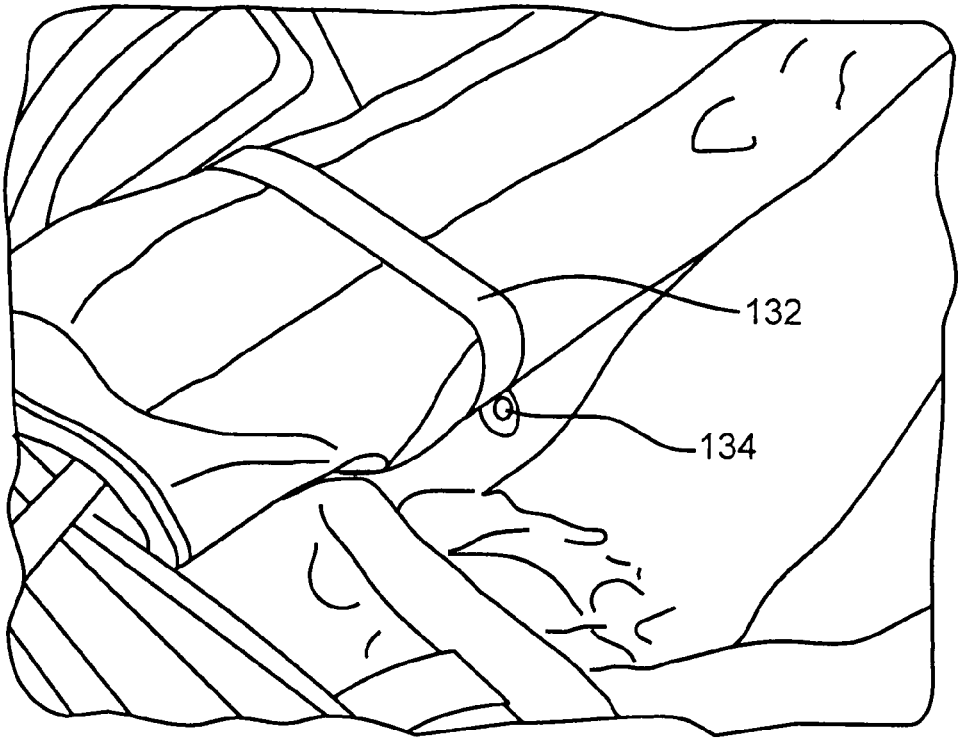
FIG. 5 is an enlarged perspective view of an exemplary head cell attached to the head end of the bed deck, wherein the head cell is deflated for ease in attachment.
Figure 6:
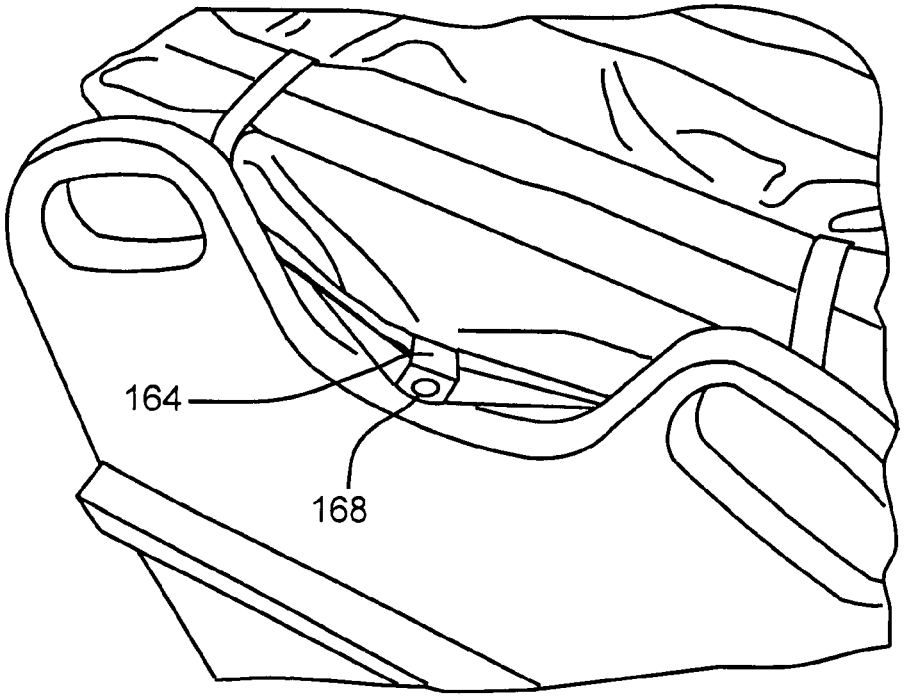
FIG. 6 is an enlarged perspective view of an exemplary head cell configuration attached to the bottom portion of the cover at the head end of the bed deck.

The head cell configuration 110 may be separate from the main body cell configuration 112 as shown to accommodate a built-up region 116 (shown in FIG. 2) at the head end of the bed deck 22, which is common to the bed manufactured and sold under the name VERSACARE by Hill-Rom Company, Inc. Hence, the head cell configuration 110 may be substantially coplanar with the main body cell configuration 112 and extend beyond the main body cell configuration 112 over built-up region 116. The head cell configuration 110 may be attached in any suitable manner. The exemplary head cell configuration 110 is attached by one or more straps 132 that are attached to the fabric tub and extend over the head cell configuration 110 and attached to the fabric tub via snaps 134, as shown in FIG. 5. Additionally, the head cell configuration 110 may have one or more tabs 164 that attach to the fabric tub via one or more snaps 168 or other suitable fasteners, as shown in FIG. 6.

Figure 7:
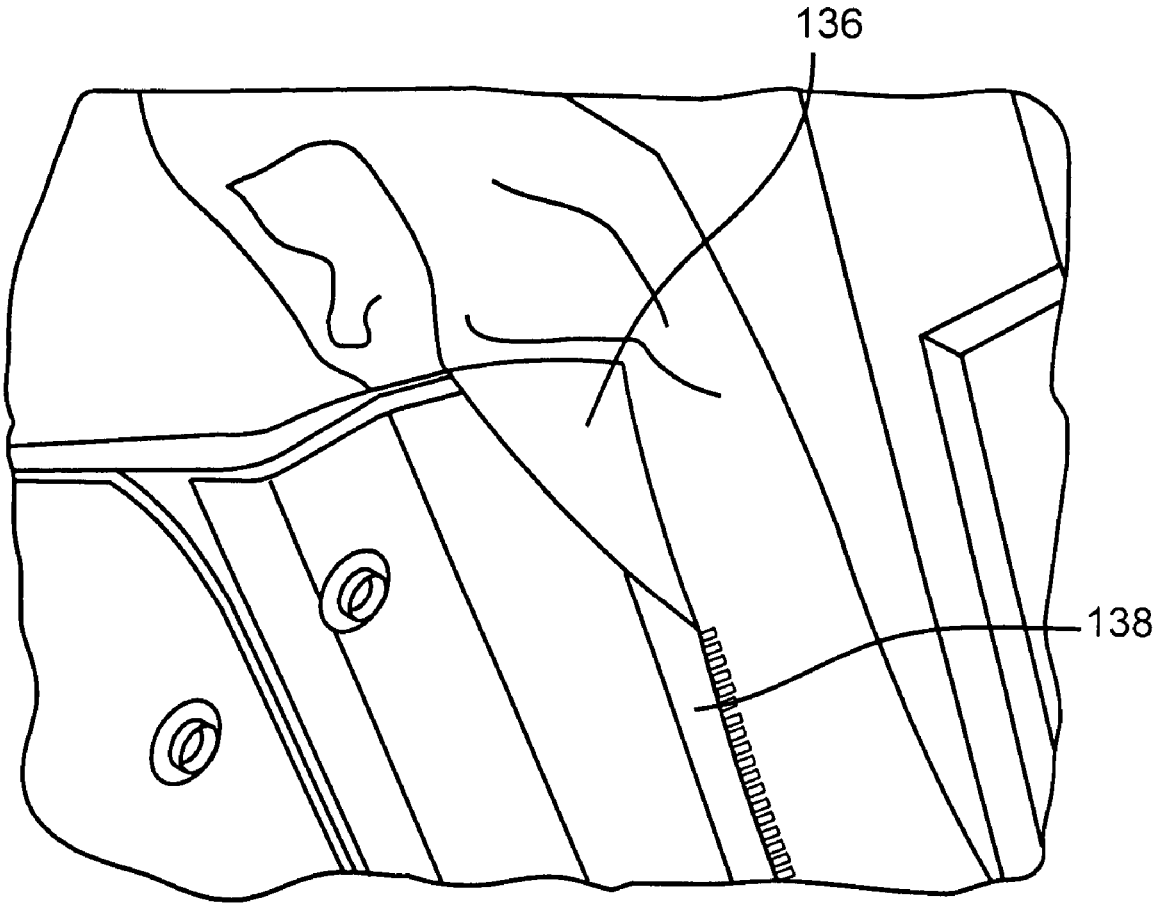
FIG. 7 is an enlarged perspective view of an exemplary gusset at the corner of the mattress for receiving a corner of the bed deck.

As shown in FIG. 7, the fabric tub may have a V-shaped pocket or gusset 136, or other suitable structure, at its corners near the head end of the bed deck 22 for receiving the corners 138 of the bed deck 22 to hold the corners of the fabric tub in position in relation to the corners 138 of the upper deck 44 of the bed deck 22 at the head end of the bed deck 22. In the exemplary mattress 28, the gussets 136 are laterally spaced apart so that the fabric tub fits substantially taut between the corners 138 of the upper deck 44 of the bed deck 22 so that corners of the upper deck 44 of the bed deck 22 remain in the gussets 136 to hold the fabric tub in position in relation to the upper deck 44 of the bed deck 22. It should be appreciated that all four corners of the fabric tub may be provided with a gusset, or other suitable structure, for holding the fabric tub in position in relation to all four corners of the bed deck 22.

Figure 8:
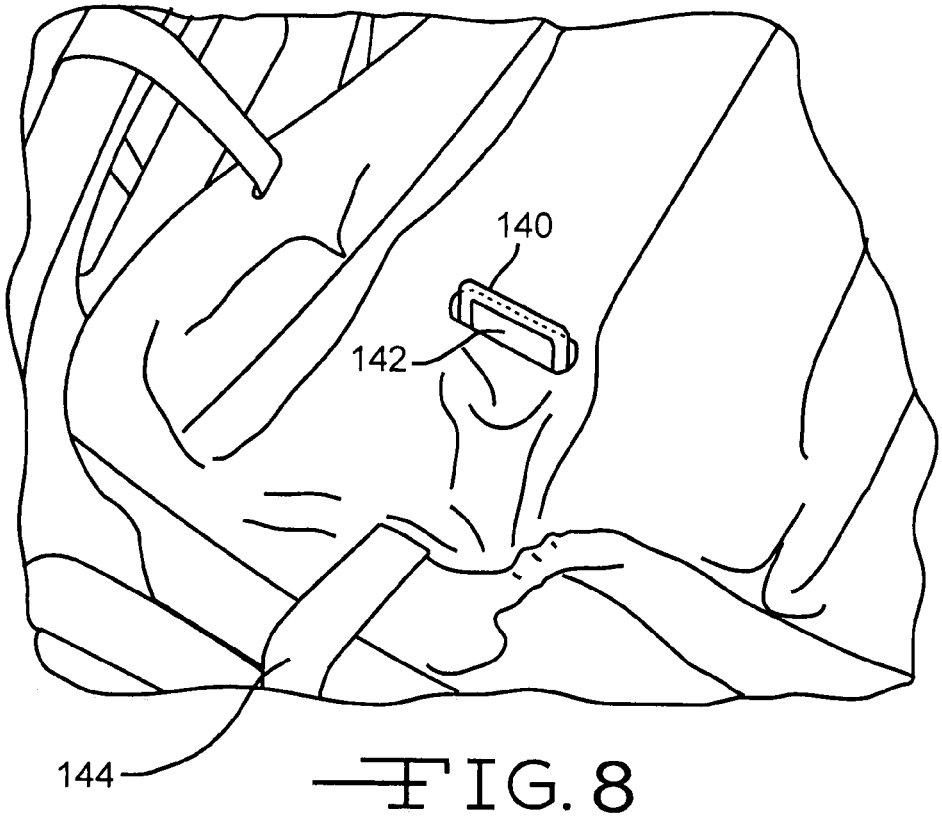
FIG. 8 is an enlarged perspective view of the bottom portion of the cover being attached to the head end of the bed deck.

The fabric tub may be attached to the head end of the bed deck 22 by any suitable means. As shown in FIG. 8, the lower deck 48 of the bed deck 22 may have a loop 140, such as a D-ring or other suitable structure, proximate each side wall 50 of the bed deck 22 at the head end of the bed 10. The fabric tub may be provided with a slit 142 or other suitable opening at its head end for receiving the loop 140 so that the loop 140 may pass through the slit 142 and therefore through the head end of the fabric tub. The fabric tub may be provided with a strap 144 that may pass through the loop 140 and be provided with a fastener, such as a hook and loop fastener, that permits the strap 144 to be secured to the loop 140.

Figure 9:
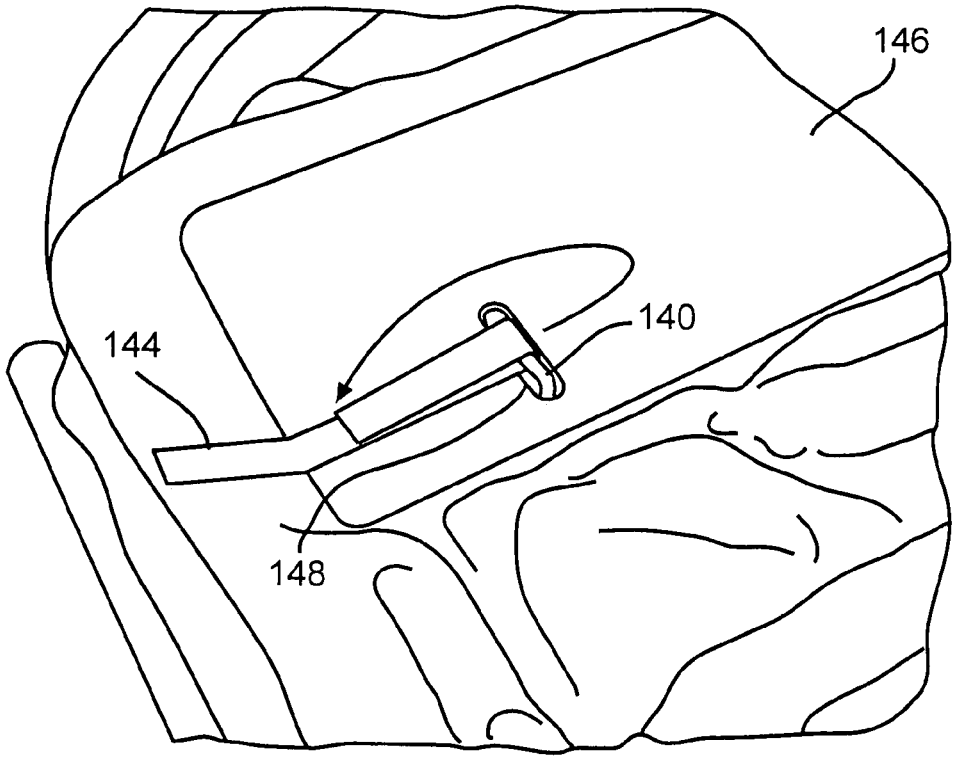
FIG. 9 is an enlarged perspective view of a panel being attached to the head end of the bed deck.

As shown in FIG. 9, the exemplary mattress 28 may be provided with a rigid or substantially rigid yet pliable panel 146 that may be positioned at or near the head end of the bed deck 22. The panel 146 may be formed of any suitable material including but not limited to a plastic sheet. The panel 146 may be attached to the head end of the bed deck 22 by any suitable means. The panel 146 may be provided with a slit 148 or other suitable opening that may align with the slit 142 in the fabric tub and through which the loop 140 may pass to secure the panel in relation to the fabric tub and bed deck 22.

Figure 10:
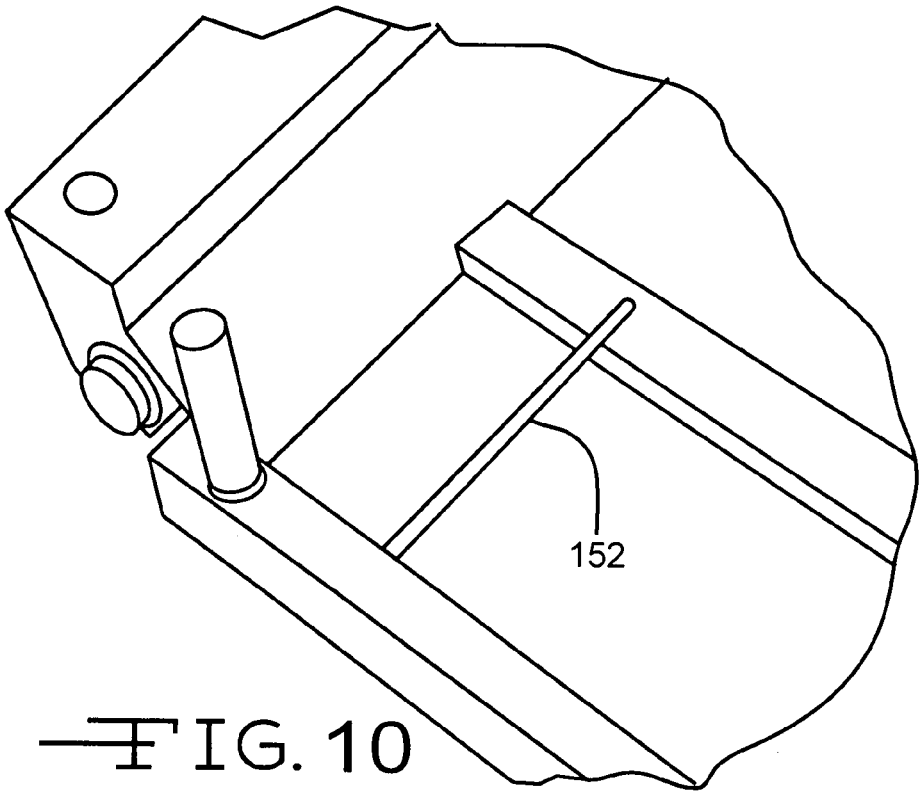
FIG. 10 is an enlarged perspective view of an attachment bar at the foot end of the bed deck.
Figure 11:
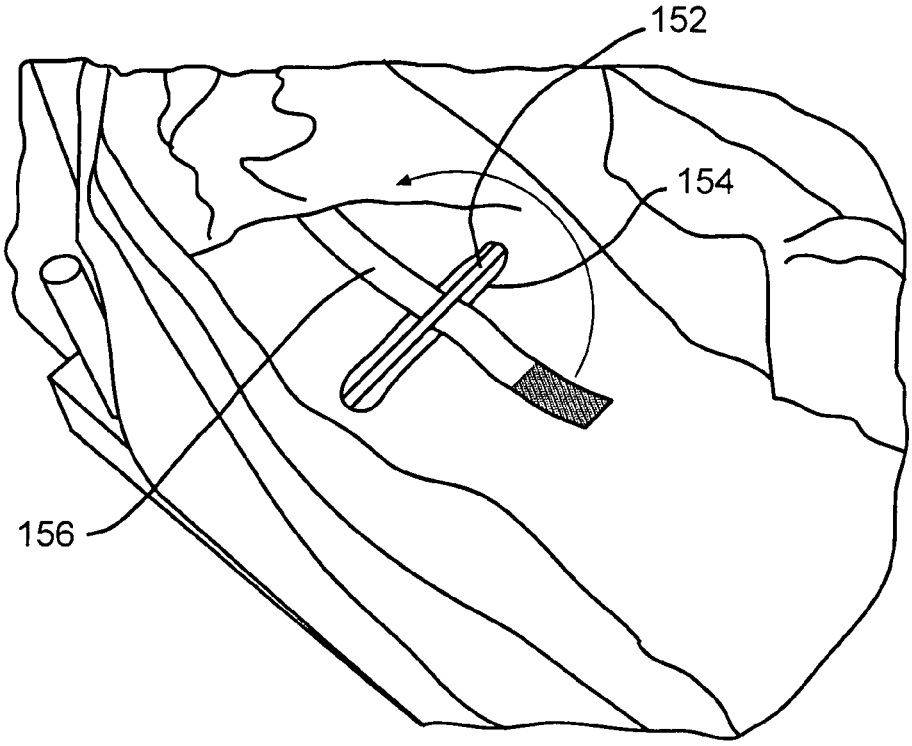
FIG. 11 is an enlarged perspective view of the bottom portion of the cover being attached to the foot end of the bed deck via the attachment bar in FIG. 9.

The fabric tub may be attached to the foot end of the bed deck 22 by any suitable means. As shown in FIG. 10, the lower deck 48 of the bed deck 22 may have an attachment bar 152, or other suitable structure, proximate each side wall 50 of the bed deck 22 at the foot end of the bed 10. The attachment bar 152 may be integral with the foot section 36 or foot pan 42 of the bed deck 22. As shown in FIG. 11, the fabric tub may be provided with a slit 154 or other suitable opening at its foot end for receiving the attachment bar 152 so that the attachment bar 152 may pass through the slit 154 and therefore through the foot end of the fabric tub. A strap 156 or other suitable structure may pass through the attachment bar 152 to hold the fabric tub in a substantially fixed relation to the attachment bar 152. The strap 156 may be provided with a fastener, such as a hook and loop fastener, that permits the strap 156 to be secured to the attachment bar 152.

Figure 12:
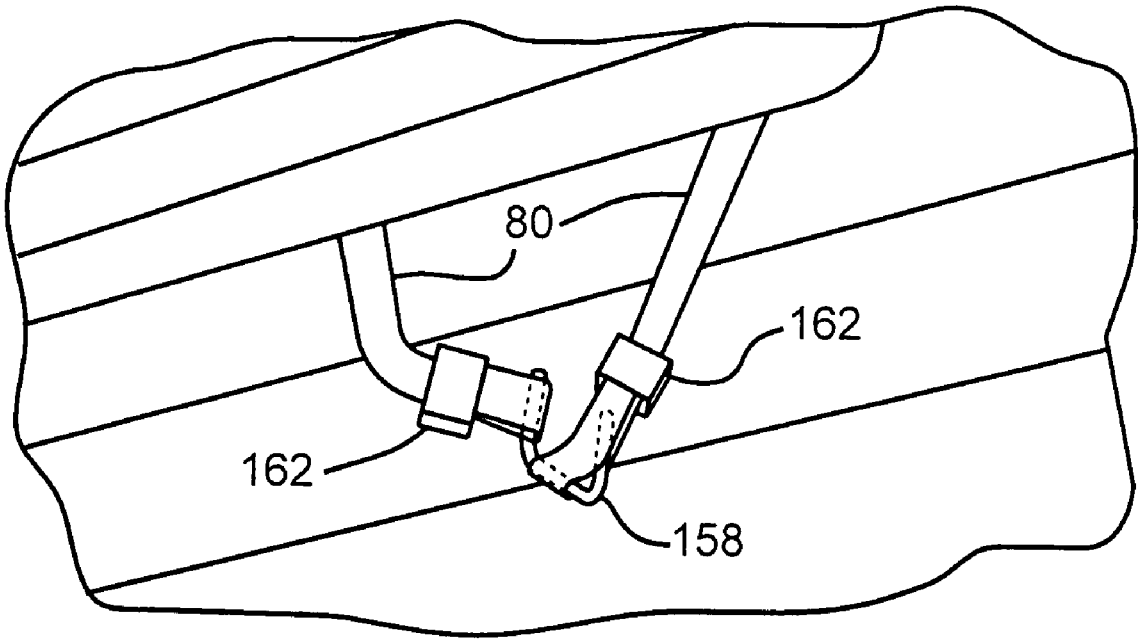
FIG. 12 is an enlarged perspective view of the exemplary mattress attached to the bed.

The fabric tub may be attached to the bed 10 by any suitable means. As shown in FIG. 12, the bed 10 may have one or more loops 158, or other suitable structure, along each side of the bed 10 for attachment of one or more straps, for securing the fabric tub to the bed deck 22, the bed frame 20, or other suitable structure of the bed 10. The loops 158 may be attached to the bed deck 22 or an articulating portion of the bed frame 20. The straps 80 positioned outside and below the cover 60 may be attached to the loops 158. In the exemplary mattress, straps 80 are provided along the side of the fabric tub at positions corresponding to the head, seat and foot sections 32, 34, 36 of the bed deck 22. The straps 80 may be secured to the loops 158 in any suitable manner such as with buckles or other suitable fasteners for buckling or otherwise securing the straps 80 to the loops 158.

With the fabric tub secured in place in relation to the bed deck 22 and the cell configurations 110, 112, 114 secured in place in relation to the fabric tub, the therapy cover may be attached to the fabric tub. This may be achieved in any suitable manner. For example, the top and bottom cover sections 72, 74 of the exemplary mattress 28 may be attached to one another by one or more zippers 172. It should be appreciated that any suitable structure may be used for attaching the therapy cover to the fabric tub, or otherwise holding the two cover sections 72, 74 in relation to one another.

The cell configurations 110, 112, 114 may be charged in any suitable manner. For example, as stated above, the LAL mattress 56 may have three cells 66 in the head and seat zones 92, 94 and two cells 66 in the foot zone 96. The cells 66 in each zone 92, 94, 96 may be in fluid communication with the other cells 66 in the same zone 92, 94, 96 so as to be at the same pressure. This may be achieved by the provision of an open passage between the cells 66 or by the provision of a manifold or other suitable structure interconnecting the cells 66. Each zone 92, 94, 96 may be provided with one or more fittings for the connection of hose 98 or other suitable conduit, which in turn may be connected to the controller pump 82 for filling the cells 66 to a desired pressure. The desired pressure zones 92, 94, 96 may be achieved via the use of suitable orifices between the controller pump 82 and the cells 66 in the corresponding zones 92, 94, 96. The head cell configuration 110 may be connected to the controller pump 82 and filled to a desired pressure in a similar manner.

As stated above, the safety mattress 58 may be formed from contiguous cells 68, 68' that are at the same pressure. The cells 68, 68' may be in fluid communication with one another so as to be at the same pressure. This may be achieved by an open passage between the cells 68, 68' or by the provision of a manifold interconnecting the cells 68, 68'. The safety mattress 58 may be provided with one or more fittings for the connection of hose 98 or other suitable conduit, which in turn may be connected to the controller pump 82 for filling the safety mattress 58 to a desired pressure.

Figure 13:
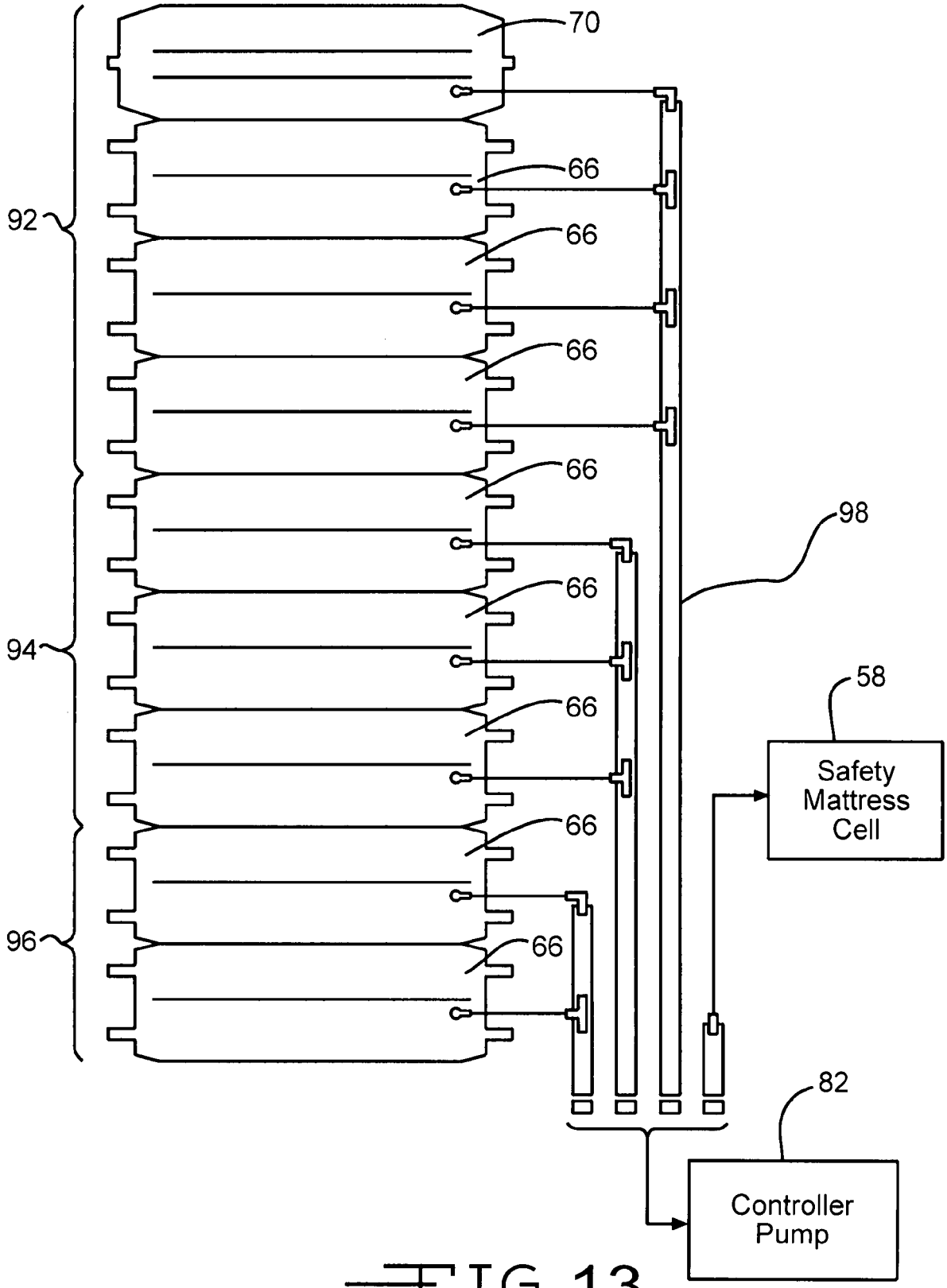
FIG. 13 is a schematic view of an exemplary plumbing configuration for the mattress.

An exemplary plumbing configuration for the mattress 28 is schematically shown in FIG. 13. In the illustrated plumbing configuration, a plurality of hoses 98 is connected to the controller pump 82. One hose 98 may be connected from the controller pump 82 through an orifice to the nipple of one or more cells or cell pairs in the foot zone 96 by a T fitting and then may terminate at the nipple of another cell or cell pair in the foot zone 96 through an L fitting, as shown. The controller pump 82 may be connected to the nipples of the cells or cell pairs in the other zones 92, 94 through other orifices, T fittings, and L fittings in a similar manner. The head cell configuration 110 may be similarly connected to the controller pump 82 via hose 98 and fittings. The safety mattress 58 may be connected to the controller pump 82 via a hose 98 through a check valve to yet another fitting.

In operation, the control pump 82 may charge the cells 66, 68, 70 by supplying air to the cells 66, 68, 70 through the hoses 98, fittings, and manifolds. The control pump 82 operates continuously to continuously supply air to the LAL mattress cells 66 to maintain the LAL mattress cells 66 at a desired pressure, even while air is continuously lost from the LAL mattress cells 66 via the air bleed holes perforating the cells 68. The same control pump 82 may supply air to the head cell configuration 110, which may be one or more low air loss cells or sealed (non-perforated) air cells, and the safety mattress cells 68, 68'. A series of orifices and check valves may be used to regulate air flow and maintain air pressure in the cells 66, 68, 70, as should be commonly understood by one of ordinary skill in the art.

Figure 14A:
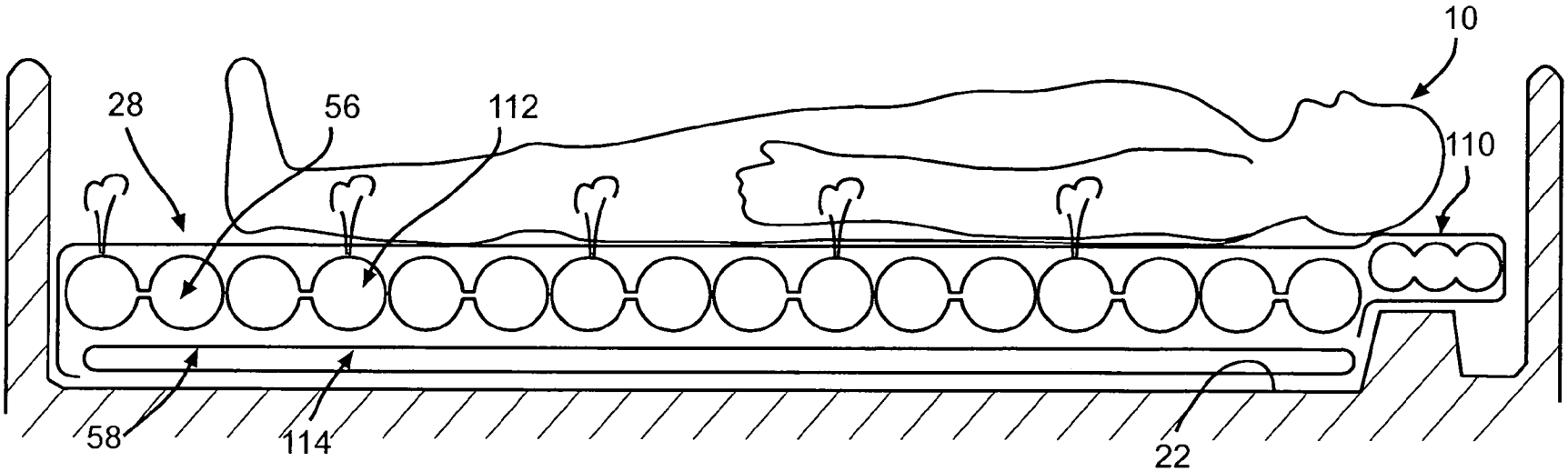
FIGS. 14A-14C are diagrammatic sectional views in elevation of the exemplary mattress partially deflated and compressed to shorten the length of the mattress.
Figure 14B:
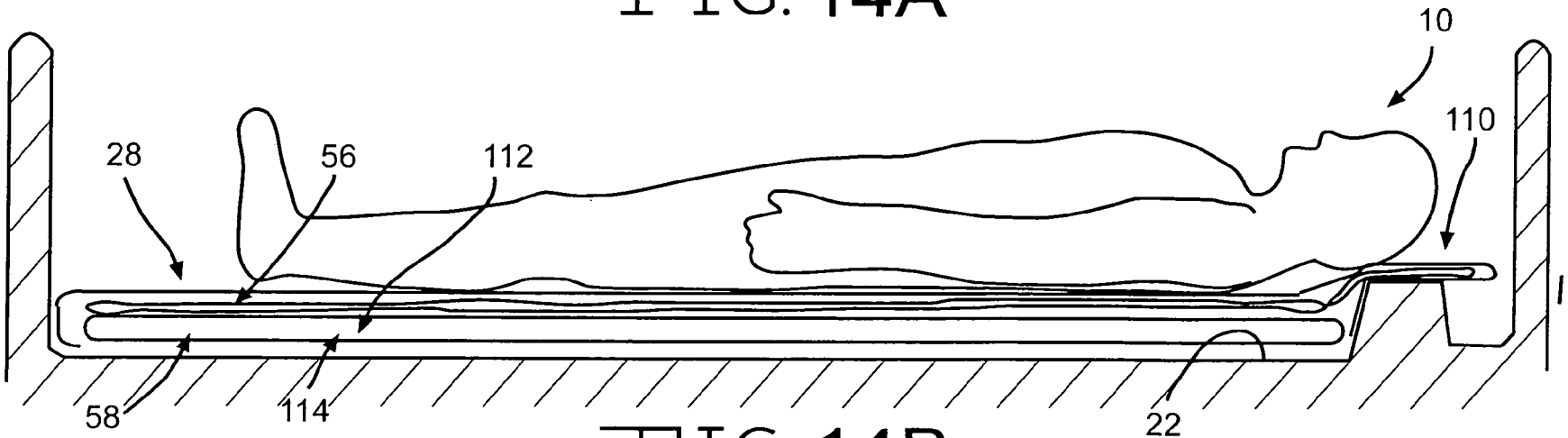
Figure 14C:
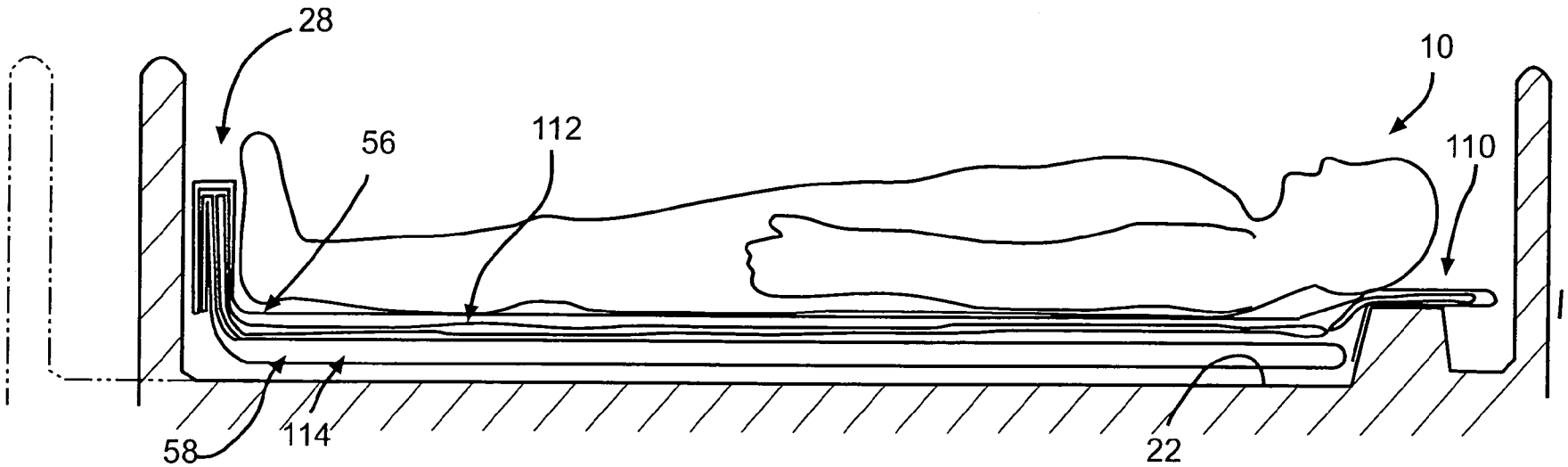

When transporting a person using the bed 10, it may be desirable for the bed 10 to fit in relative narrow confines. In such case, the LAL mattress 56 may be deflated while the safety mattress 58 remains inflated or charged with air. In this condition, the safety mattress 58 may be buckled or compressed or otherwise shortened in length without being deflated and while still supporting the person using the mattress 28. This is useful when transporting the person, for example, in an elevator. The secure attachment of the fabric tub to the bed deck 22 and the cell configurations 110, 112, 114 to the fabric tub may permit the mattress 28 to retain reasonable conformity to the bed deck 22 even if the length of the bed 10 is shortened, as shown in FIGS. 14A-14C.

Figure 15:
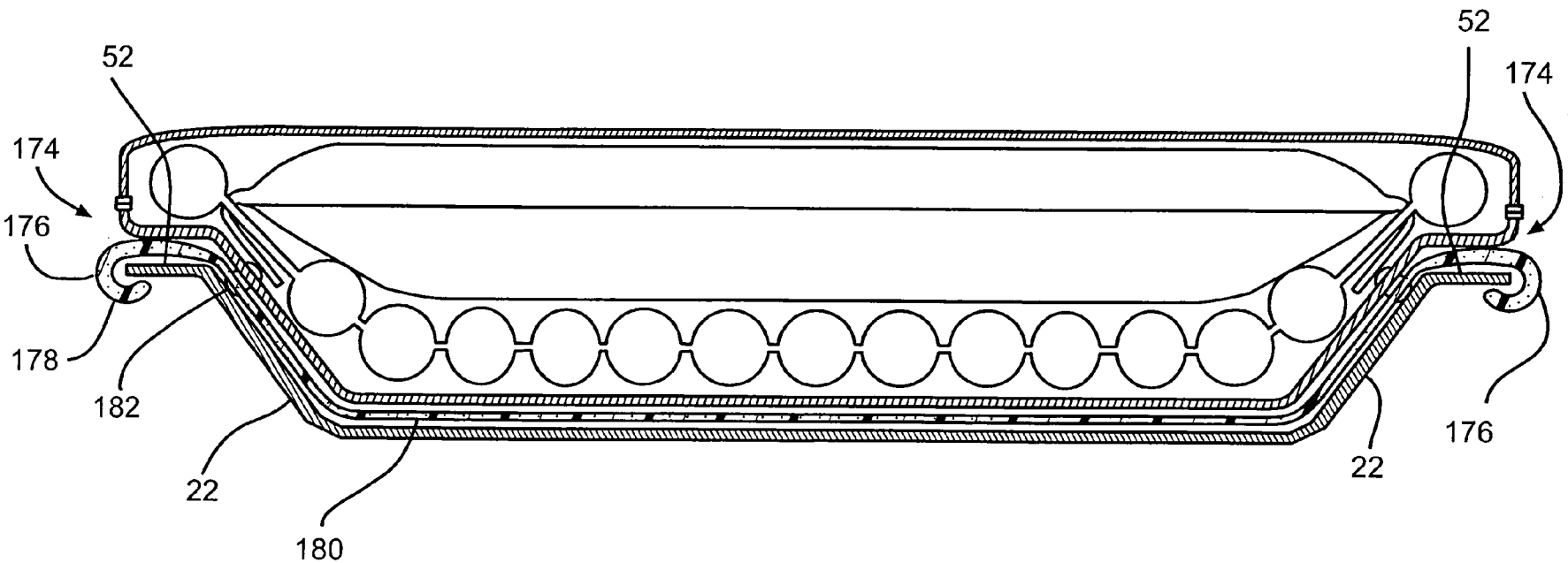
FIG. 15 is an enlarged sectional view of the bed deck, mattress, and exemplary edge protection.
Figure 16:
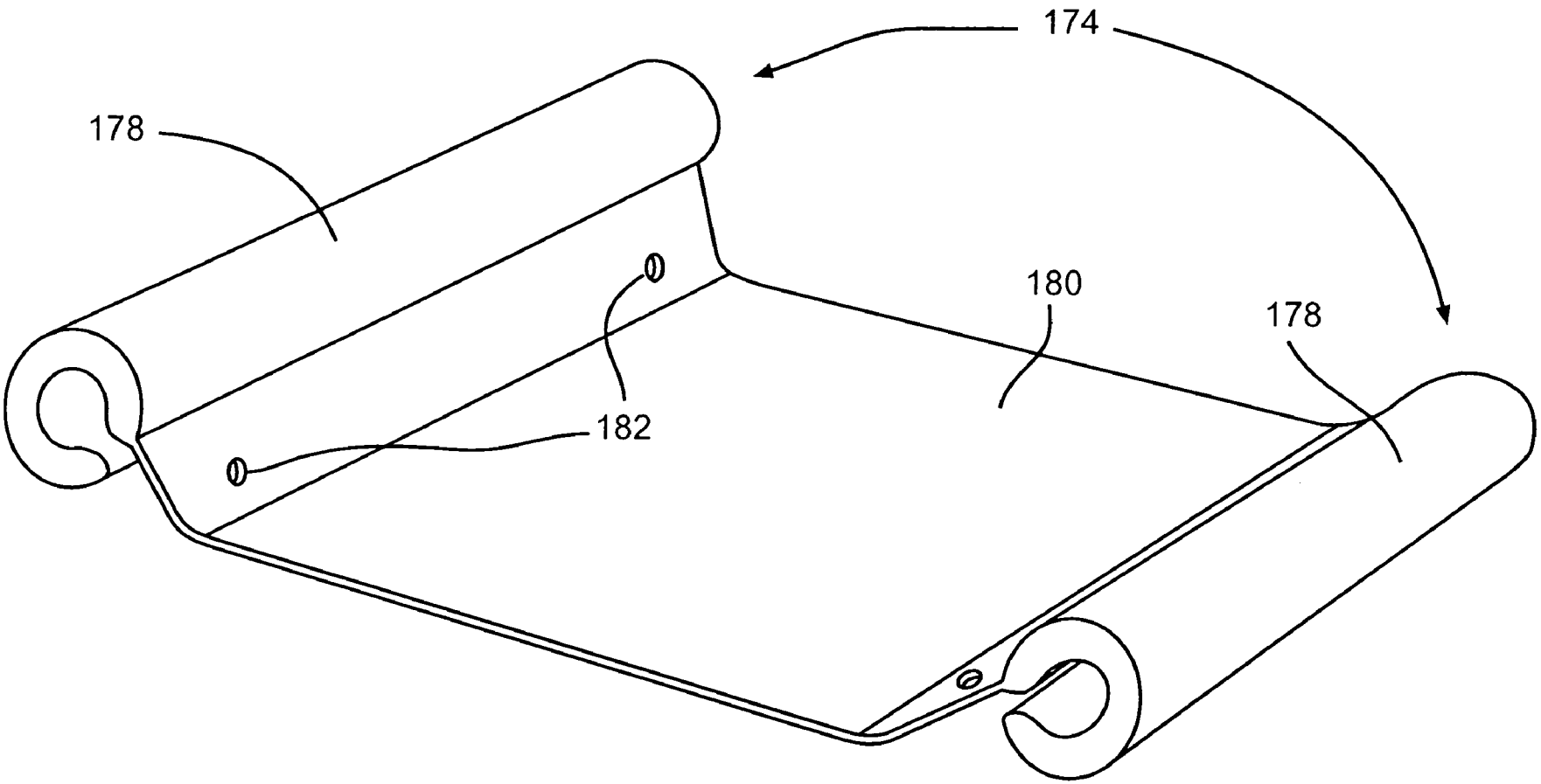
FIG. 16 is a perspective view of the edge protection shown in FIG. 15.

The mattress 28 may be provided with integral or optional edge protection 174, as shown in FIGS. 15 and 16. This may be useful if the bed deck 22 has an edge (e.g., upper deck side portions 52) that is folded up or rigid to the extent that the edge may be uncomfortable to a person entering or exiting the bed 10. If a person using the bed 10 is perched on the edge, more pressure is applied to the person, resulting in greater discomfort. A person getting in or out of the bed 10 may sustain injury on the edge. The edge protection 174 may be shaped to wrap around or otherwise cover the edge of the upper deck 44, or some portion of the upper deck 44, and provides added protection for reducing the risk of discomfort or injury. The edge protection may include a cushion material 176. Although any suitable cushioning material may suffice, the exemplary edge protection comprises foam, such as ethylene propylene diene monomer (EPDM) and polyester. Other cushions including fluid filled bladders may provide a suitable cushion. The exemplary cushion is covered with a fabric cover 178, which may be integral with and attached to a sling 180 that extends across the bed deck 22 beneath the mattress 28. The sling 180 may be formed from any suitable material and may be attached to the fabric tub, for example, via snaps 182 or other suitable fasteners.

Figure 17:
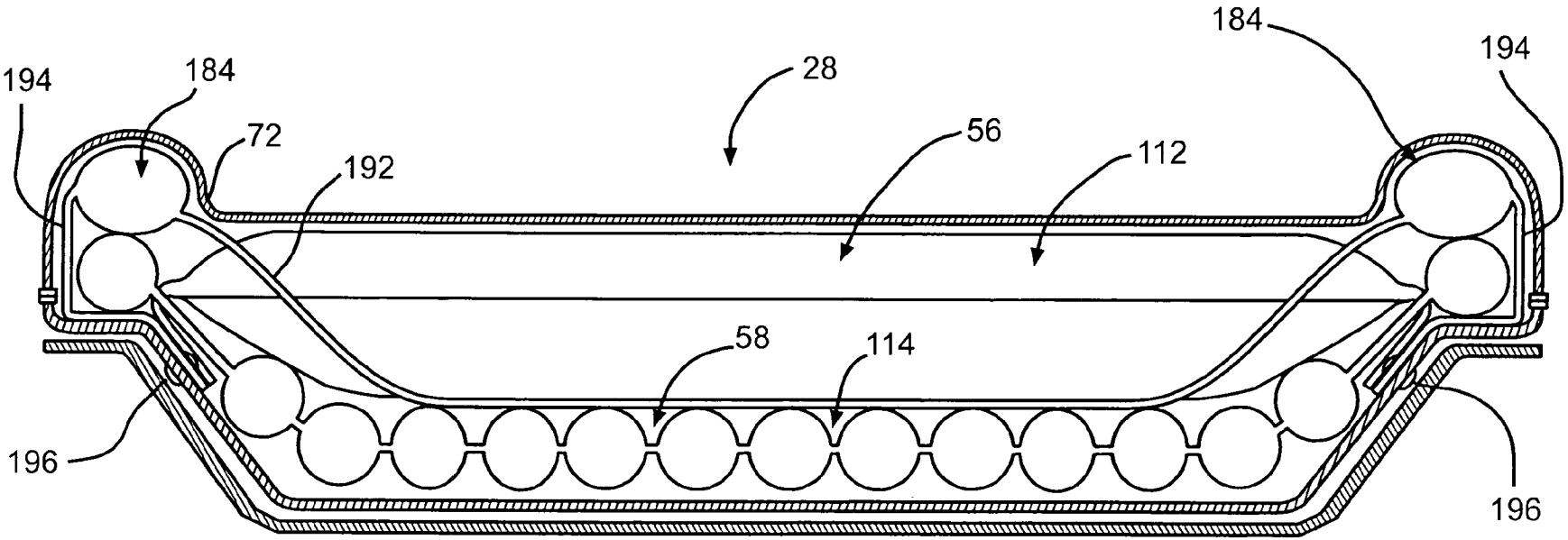
FIG. 17 is an enlarged sectional view of the bed deck, mattress, and exemplary bolsters.
Figure 18:
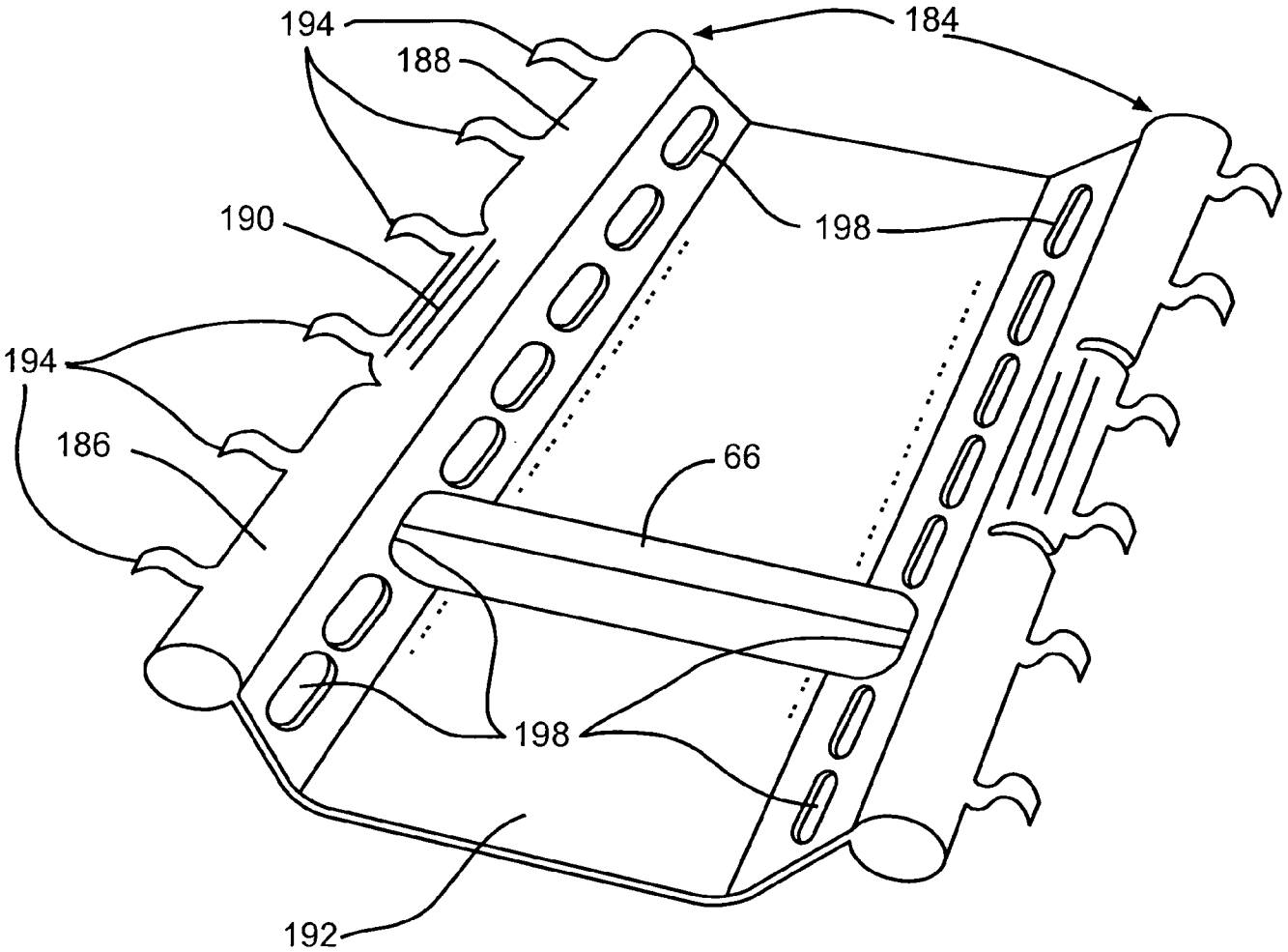
FIG. 18 is a perspective view of the bolsters shown in FIG. 17.

The mattress 28 may be provided with integral or optional bolsters 184, as shown in FIGS. 17 and 18. The bolsters 184 may function as passive devices that may be useful in reducing the risk that the person using the mattress 28 may inadvertently roll off the mattress 28. An example of such a bolster 184 is described in U.S. Pat. No. 7,155,766, granted on Jan. 2, 2007, the disclosure of which is hereby incorporated by reference. The bolsters 184 may include one or more cells 186, 188, 190 (shown in FIG. 18) that extend longitudinally along the sides of the mattress 28. The exemplary bolsters may be integral with or attached to a sling 192 that extends across and between the mattress portions 56, 58. The bolsters 184 may have one or more straps 194, or other suitable structure, for attaching the bolsters 184 to the fabric tub. The illustrated bolsters 184 have straps 194 attached along the outermost sides of the bolsters 184 and extend outwardly about and below the upper outermost side cells 68' of the safety mattress 58 and attached to the fabric tub via snaps 196 or other suitable fasteners.

As shown in FIG. 18, the bolster cells 186, 188, 190 may include a head and foot region 186, 188 and an entry/exit region 190, across which the person using the mattress 28 may enter and exit the bed 10. The bolster 184 may sit under the LAL mattress 56 and may serve to support the LAL mattress 56. The sling 192 may be provided with a series of hole pairs comprising holes 198 in opposing sides of the sling 192 for receiving the LAL mattress cells 66. The cells 66 may extend across the sling 192 and be held in place in relation to the sling 192 by the holes 198. The sling 192 may extend across the safety mattress 58 so that the LAL mattress 56 and bolster sling 192 may nest in the safety mattress 58. The bolsters straps 194 may then extend around the upper outermost side cells 68' of the safety mattress 58 and attach to the fabric tub. The therapy cover may then cover the cell configurations 110, 112, 114 and the bolster 184 and be fastened to the fabric tub to hold the cell configurations 110, 112, 114 and the bolster 184 therein.

The invention has been explained and illustrated in an exemplary embodiment. However, it must be understood that the invention may be practiced otherwise than as specifically explained and illustrated without departing from its spirit or scope.

What is claimed is:

1. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess;

a safety mattress extending across the lower bed deck and having air cells including upper outermost side air cells resting on the upper bed deck; and a fabric tub supporting the safety mattress, the safety mattress being attached to the fabric tub to hold the safety mattress in place in relation to the fabric tub, the fabric tub in turn being attached to the bed deck to hold the fabric tub in place in relation to the bed deck.

2. The bed of claim 1 wherein the bed deck had a head end with opposing corners and the fabric tub has a head end with opposing corners and a pocket at the opposing corners for receiving the corners of the bed deck to hold the corners of the fabric tub in position in relation to the corners of the bed deck.

3. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess;

a safety mattress extending across the lower bed deck and having air cells including upper outermost side air cells resting on the upper bed deck; and a low air loss mattress extending crosswise relative to the safety mattress between the upper outermost side cells of the safety mattress;

wherein the bed deck is adjustable in length and the mattress is structured so that the low air loss mattress can be deflated and the safety mattress can be buckled when the length of the bed deck is adjusted to a shorter length.

4. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess;

a safety mattress extending across the lower bed deck and having air cells including upper outermost side air cells resting on the upper bed deck;

a low air loss mattress extending crosswise relative to the safety mattress between the upper outermost side cells of the safety mattress; and a fabric tub supporting the low air loss mattress and the safety mattress, the fabric tub having opposing sides and one or more mattress supports on each of the sides attached to the bed deck to hold the fabric tub in place in relation to the bed deck.

5. The bed of claim 4 wherein the low air loss mattress and the safety mattress are attached to the fabric tub in a manner so as to form a shape wherein the outermost side cells of the safety mattress are elevated above the rest of the safety mattress.

6. The bed of claim 4 further comprising straps originating from opposing sides of the fabric tub, the safety mattress being attached to the fabric tub by passing the straps through longitudinally spaced openings in the safety mattress adjacent the outermost side cells of the safety mattress and attached to the fabric tub to hold the safety mattress in place in relation to the fabric tub.

7. The bed of claim 4 further comprising straps originating from opposing sides of the low air loss mattress, the low air loss mattress being attached to the fabric tub by passing the straps through longitudinally spaced openings in the safety mattress adjacent the outermost side cells of the safety mattress and being attached to the fabric tub to hold the safety mattress in place in relation to the fabric tub.

8. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess;

a safety mattress extending across the lower bed deck and having air cells including upper outermost side air cells resting on the upper bed deck; and three cell configurations, including a safety cell configuration comprising the safety mattress, a main body cell configuration comprising a low air loss mattress supported by the safety cell configuration, and a head cell configuration comprising one or more head cells arranged substantially coplanar with the low air loss mattress.

9. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess; and a safety mattress extending across the lower bed deck and having air cells including upper outermost side air cells resting on the upper bed deck;

wherein the safety mattress is formed from cells all at the same pressure.

10. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess; and a safety mattress extending across the lower bed deck and having air cells including upper outermost side air cells resting on the upper bed deck;

wherein the bed deck is an articulating bed deck having two folding points and the safety mattress has two folding points that substantially coincide with the folding points of the articulating bed deck; and wherein the low air loss mattress has cells dimensioned so that the separation between the cells is substantially coincident with the pivot points that occur between the head and seat sections and the seat and foot sections of the articulating bed deck.

11. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess; and a safety mattress extending across the lower bed deck and having air cells including upper outermost side air cells resting on the upper bed deck;

wherein the bed deck is an articulating bed deck having the head and seat sections, wherein the head section articulates relative to the seat section at a pivot point, the safety mattress further comprising opposing sides and a V-section along each of the sides of the safety mattress, the V-section having air occluded therefrom to permit compression of the V-section without buckling of the V-section at the pivot point between the head and seat sections of the bed deck when the bed deck is articulated.

12. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess;

a safety mattress extending across the lower bed deck and having air cells including upper outermost side air cells resting on the upper bed deck; and an edge protection attached to at least a portion of the upper deck of the bed deck, the edge protection including a cushion material.

13. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess; and a safety mattress extending across the lower bed deck and having air cells including upper outermost side air cells resting on the upper bed deck;

wherein the upper deck of the bed deck has opposing sides with an opposing edge protection attached to the opposing sides, the edge protection including a cushion material covered with a fabric cover, the edge protection being attached to a sling that extends across the bed deck beneath the mattress.

14. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess;

a safety mattress extending across the lower bed deck and having air cells including upper outermost side air cells resting on the upper bed deck; and a bolster serving as a passive device that reduces the risk that a person using the mattress will inadvertently roll off the mattress, the bolster including one or more cells extending longitudinally along the sides of the mattress.

15. A bed comprising:

a bed frame;

a bed deck supported by the bed frame, the bed deck comprising a step deck, including a lower deck, an upper deck, a side wall connecting the lower deck to the upper deck, and a recess defined by the lower deck and the side wall, the side wall at least partially surrounding the recess; and a safety mattress extending across the lower bed deck and having air cells including upper outermost side air cells resting on the upper bed deck;

wherein the upper deck of the bed deck has opposing sides with opposing bolsters serving as passive devices that reduce the risk that a person using the mattress will inadvertently roll off the mattress, the bolster including one or more cells extending longitudinally along the sides of the mattress.

16. The bed of claim 15 wherein the bolsters are attached to a sling that extends across the safety mattress, the sling having opposing sides and being provided with a series of holes in the opposing sides of the sling for receiving low air loss mattress cells, the low air loss mattress cells extending across the sling and being held in place in relation to the sling by the opposing holes, the low air loss mattress cells forming a low air loss mattress that nests in the safety mattress.

17. A bed comprising:

a bed frame;

a bed deck supported by the bed frame, the bed deck comprising a step deck, including a lower deck, an upper deck, a side wall connecting the lower deck to the upper deck, and an recess defined by the lower deck and the side wall, the side wall at least partially surrounding the recess;

a safety mattress having upper outermost side air cells resting on the upper bed deck, air cells extending across the lower bed deck between the upper outermost side air cells, and a web extending along the side wall of the bed deck between the air cells extending across the lower bed deck and the upper outermost side air cells, the web providing a space between the upper outermost side cells and the air cells extending across the lower bed deck adjacent the uppermost side cells, wherein the space is greater than the space between other adjacent cells between the uppermost side cells.

* * * * *